United States Patent [19]

Johnston et al.

[11] Patent Number: 4,905,458

[45] Date of Patent: Mar. 6, 1990

[54] SADDLE GIRTH

[76] Inventors: William T. Johnston, 3214 Laubert Rd., Randolph, Ohio 44268; Harold Timberlake, 1614 Industry Rd., Atwater, Ohio 44201

[21] Appl. No.: 275,410

[22] Filed: Nov. 23, 1988

[51] Int. Cl.[4] ..... B68C 1/00

[52] U.S. Cl. ..... 54/23; 54/44

[58] Field of Search ..... 54/23, 44, 37, 38, 79, 54/44, 46; 119/29

[56] References Cited

U.S. PATENT DOCUMENTS

| | | | |
|---|---|---|---|
| 2,130,214 | 9/1938 | Wright | 54/23 |
| 2,252,257 | 8/1941 | Harvey | 54/23 |
| 3,828,521 | 8/1974 | Dulaney | 54/23 |
| 4,147,015 | 4/1979 | Land | 54/23 |
| 4,187,663 | 2/1980 | LaCroix, Jr. | 54/23 |
| 4,506,496 | 3/1985 | Olson | 54/44 |
| 4,570,424 | 2/1986 | Simpson | 54/23 |

FOREIGN PATENT DOCUMENTS

| | | | |
|---|---|---|---|
| 2821475 | 11/1979 | Fed. Rep. of Germany | 54/37 |
| 479581 | 4/1916 | France | 54/23 |
| 14346 | 3/1985 | France . | |

*Primary Examiner*—John Weiss

*Attorney, Agent, or Firm*—Fay, Sharpe, Beall, Fagan, Minnich & McKee

[57] ABSTRACT

A saddle girth includes an elongated member having a length sufficient to completely encircle about the mid-section of an animal. An inner surface of the elongated member faces the animal during use. Gripping members extend from the inner surface of the elongated member to the animal to increase rotatable friction forces and to decrease the likelihood that the elongated member will rotatably slip when secured into place. First interlocking hook and loop type fasteners are affixed onto portions of the elongated member at locations adapted for adjusting and securing the circumferential extent of the girth about the animal. Second interlocking hook and loop type fasteners are affixed at a saddle receiving portion of the girth. Reinforcement material is included on the elongated member at the portion where the saddle is received.

9 Claims, 2 Drawing Sheets

SADDLE GIRTH

BACKGROUND OF THE INVENTION

This invention pertains to the art of saddle girths and more particularly to saddle girths having non-slip features. This invention is particularly applicable to non-slip saddle girths featuring interlocking hook and loop type fasteners, and will be described with particular reference thereto. However, it will be appreciated that the invention has broader application and may be advantageously employed in other environments.

Saddle girths of the type to which this invention pertains ordinarily extend no further than a portion of the way around the midsection of an animal. At their extreme ends, these girths of the prior art often have fastening devices to which saddles are attached. Although these girths serve to keep the saddle in close association with the horse, they do not sufficiently prevent the saddle from rotatably slipping; nor do they assure that the saddle is securely positioned on the horse. As a result, human horseback riders have fallen from their mounts and sustained injuries when saddle girths of the prior art did not prevent the saddle from slipping around the side of the horse after having been fastened into place. In order to prevent a saddle from slipping, and further to prevent resulting injuries to horseback riders, it is desirable to develop saddle girth that offers a saddle mount that is more stable than that offered by the girths of the prior art. Moreover, it is desirable to develop a girth that has greater frictional resistance than that of girths of the prior art so as to minimize rotational movement of the girth and saddle once they are positioned about the horse's midsection. Finally, it is desirable to develop a girth that is both relatively simple to secure on a horse and situated to readily receive a saddle thereon.

The present invention contemplates a new and improved arrangement which overcomes all the abovedescribed problems and others to provide a saddle girth which exhibits a secure saddle mount as well as a means for increasing rotational friction forces to minimize slipping. The girth is relatively easy to secure on a horse, and provides an economical means for securely receiving a saddle and preventing the girth and saddle from sliding out of place. The improvement allows the circumferential extent of the girth to be adjusted, and also greatly reduces the likelihood of a rider sustaining injury as a result of a non-secure girth or saddle.

BRIEF DESCRIPTION OF THE INVENTION

In accordance with the present invention, there is provided an improved saddle girth for use in connection with a saddle and horse. The saddle girth is an elongated piece of material that wraps completely around the midsection of an animal. The girth is adjustable, and a series of hook and loop type fasteners secure its circumferential extent. A gripping feature prevents the girth from slipping out of position around the animal.

In accordance with a more limited aspect of the invention, there is provided a saddle girth that mainly includes an elongated member having a length that is sufficient to completely encircle about the midsection of an animal. An inner surface of this elongated member faces the animal during use. Gripping members extend from this inner surface to the animal so as to increase rotatable friction forces and to decrease the likelihood that the elongated member will rotatably slip when secured into place. First interlocking hook and loop type fasteners or fastener materials are affixed onto portions of the surfaces of the elongated member at locations that are adapted for adjusting and securing the circumferential extent of the girth about the animal. Further, second interlocking hook and loop type fasteners or fastener materials are affixed at a saddle receiving portion of the girth. These additional hook and loop type fasteners constitute a first saddle fastening means adapted for receiving a saddle that also has interlocking hook and loop type fasteners affixed thereunder. A second saddle fastening means, namely, a hinge and ratchet device, is carried by the elongated member for affixing a saddle to the girth. Finally, reinforcement material is included on the elongated member at the portion where the saddle is received.

As is apparent, a primary advantage of the invention is that the improved saddle girth includes gripping members which increase the rotatable friction forces and minimize the likelihood that the girth will slip.

Another advantage of the present invention is that the girth wraps completely around the animal, and securely receives a saddle thereon.

Still other advantages and benefits of the invention will become apparent to those skilled in the art upon a reading and understanding of the following detailed description.

BRIEF DESCRIPTION OF THE DRAWINGS

The invention may take form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 1:
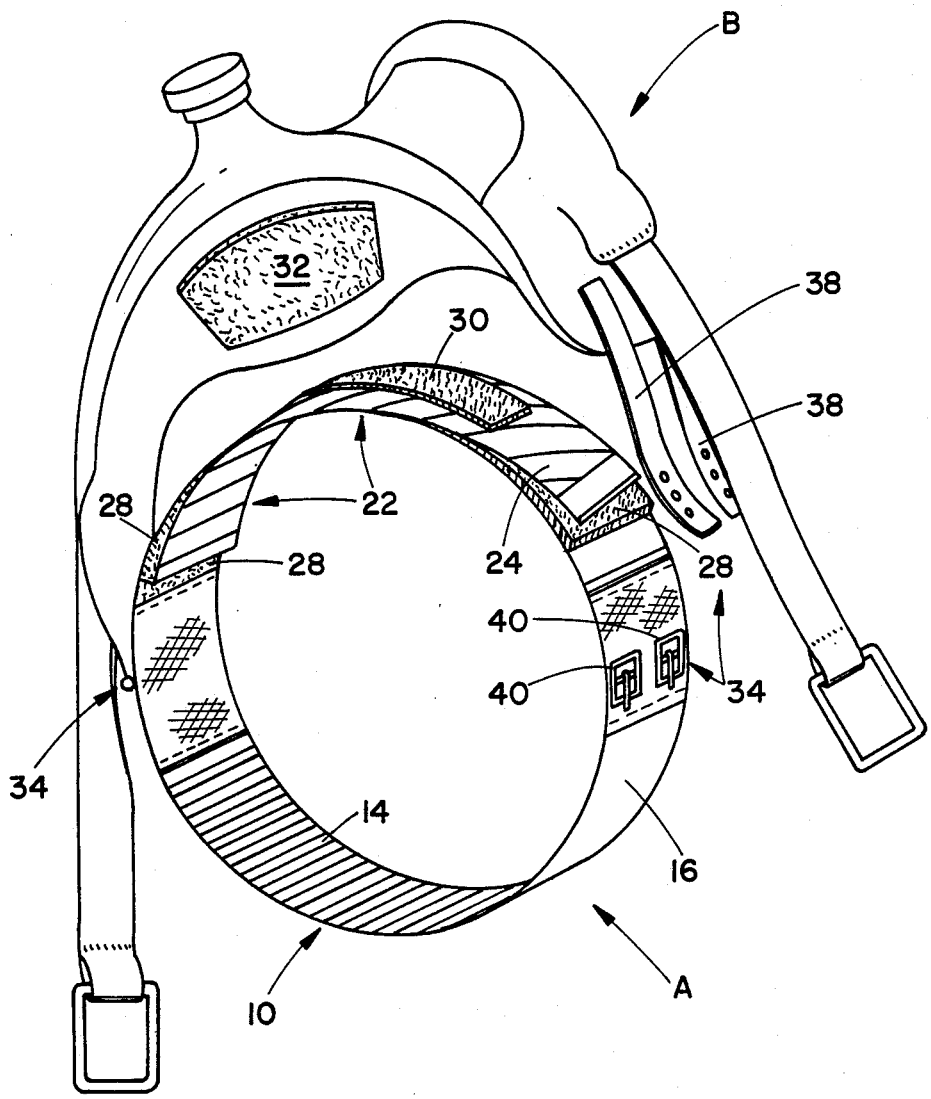
FIG. 1 is a perspective illustration of an improved saddle girth with a saddle partially fastened thereon.

Referring now to the drawings where the showings are for purposes of illustrating preferred embodiments of the invention only and not for purposes of limiting same, FIG. 1 shows an improved saddle girth A with a saddle B partially fastened thereon. The saddle girth A is a flexible elongated member 10 which can be comprised of leather, cloth, or other materials suitable for holding and securing a saddle on a horse. The elongated member 10 has an inner surface 14 and an outer surface 16. The saddle girth A wraps about the midsection of an animal, typically a horse, with the inner surface 14 abutting in close proximity with the animal's midsection. The elongated member 10 of the girth A is of a length which is greater than the circumferential extent of the midsection. Accordingly, when the girth A is properly wrapped around an animal, portions of the girth overlap to provide a region 22 at which the girth is of double thickness. This region is near the top of the animal, and when the saddle is received thereon the double thickness provides a cushion so as to ease the strain or pressure on the animal's back. A layer of reinforcement material 24 is sewn to the elongated member 10 at this portion where the saddle B is received in order to provide a greater cushion between the animal and the saddle B.

The circumferential extent of the elongated member 10 is secured about the animal by way of interlocking hook and loop type fasteners or fastener material 28. The outer surface also has another set of interlocking hook and loop type fasteners or fastener material 30 at a portion where the saddle is received. Preferably, the saddle B has hook and loop type fasteners 32 affixed to its bottom surface, so the saddle B can be fastened to the girth A. Hook and loop fasteners 30 and 32 provide a first fastening means for the saddle.

In addition to the interlocking hook and loop type fasteners 30 and 32, the saddle is affixed to the girth by way of a hook and ratchet device or second fastening means 34. Belts 38 which extend from the saddle can be operatively received by buckles 40 which are affixed on the outer surface 16 of the saddle girth A.

After a horse or other animal is exercised for a time, its midsection is known to decrease. In such an instance, the saddle girth A can become loose, at which point a rider grows in danger of falling from the mount. The present invention assists in preventing such a fall by girth A of the present invention can be easily tightened by tearing apart the interconnecting hook and loop type fasteners 28 and pulling the elongated member 10 to tighten the circumferential extent of the saddle girth A about the animal. When the hook and loop type fasteners 28 are again placed into contact with each other, they will adhere to each other and secure the circumferential extent of the elongated member 10 of the girth A.

Figure 3:
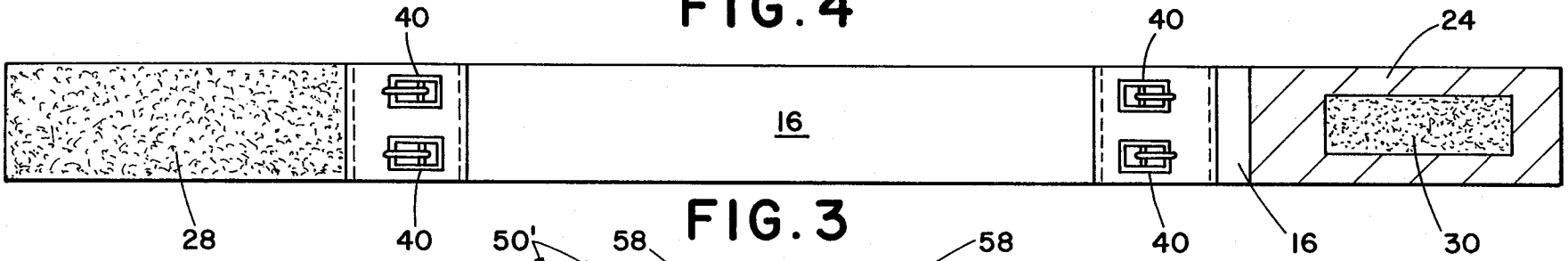
FIG. 3 is a plan view of the outer surface of the saddle girth.

FIG. 3 shows the entire outer surface 16 of the saddle girth A. A set of interlocking hook and loop fasteners 28 is shown at one end of the outer surface of the saddle girth A. The saddle receiving hook and loop type fasteners 30 are shown at the other end of the outer surface 16. In addition, buckles 40 are shown on the outer surface 16 as well. These buckles provide a second fastening means for the saddle B and are disposed on either side of the horse when the saddle is in place about the animal's midsection.

Figure 2:
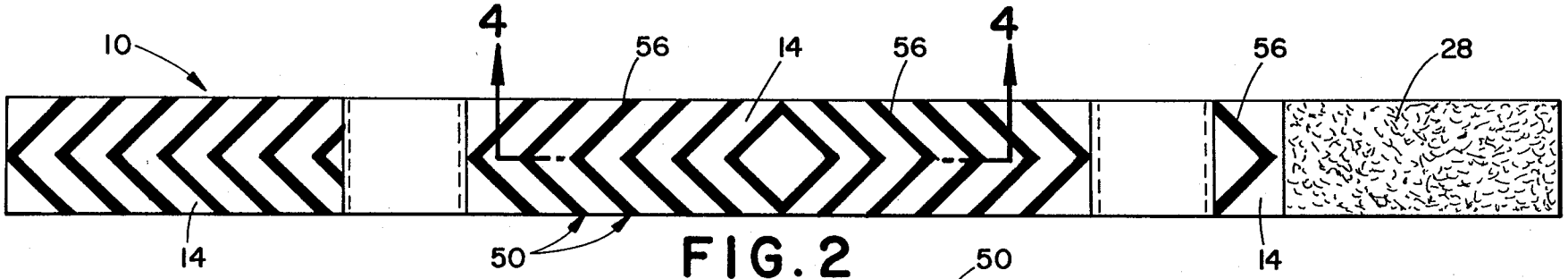
FIG. 2 is a plan view of the inner surface of the saddle girth showing a gripping device.
Figure 4:
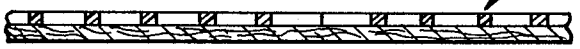
FIG. 4 is a partial side elevational view taken generally along line 4—4 of FIG. 2.

Turning to FIGS. 2 and 4, a preferred embodiment of the inner surface 14 of the saddle girth A is shown. Gripping members 50 are shown as oblique angular projections 56 from the inner surface 14. These gripping members 50 resemble tire treads, and their purpose is to provide frictional forces which serve to prevent the saddle girth A from rotationally slipping when it is in place about the animal's midsection. These gripping members 50 are comprised of cloth or leather pieces which are sewn or otherwise joined or included on the inner surface 14.

Figure 6:
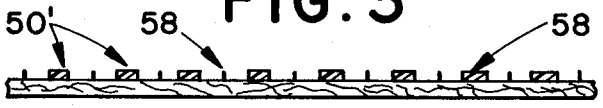
Figure 5:
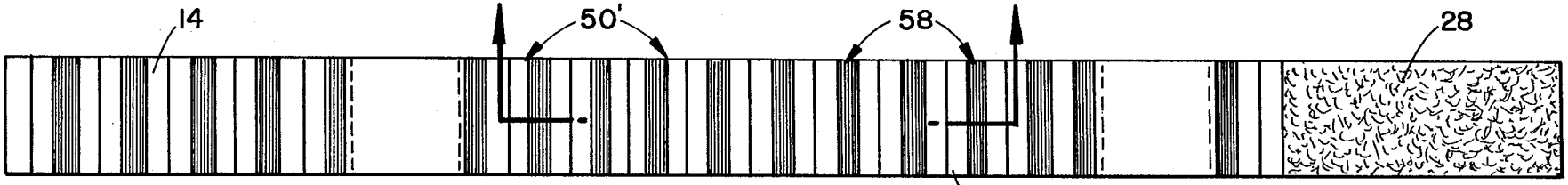
FIG. 5 is a plan view of the inner surface of the saddle girth showing a modified form of the gripping device; and, FIG. 6 is a partial side elevational view taken generally long line 6—6 of FIG. 5.

FIGS. 5 and 6 show an alternate or modified form of gripping members 50' wherein a plurality of parallel projections 58 having alternating widths, also made of cloth or leather, serve to increase frictional forces and to decrease rotational slipping of the girth about the animal. The gripping members 50 of FIGS. 2 and 4, and those of FIGS. 5 and 6, 50', simply provide a way to assist in maintaining the girth in place about the horse.

The invention has been described with reference to the preferred embodiment. Obviously, modifications and alterations will occur to others upon a reading and understanding of the specification. It is intended to include all such modifications and alterations insofar as they come within the scope of the appended claims or the equivalent thereof.

Having thus described the preferred embodiment, the invention is now claimed to be:

1. A saddle girth comprising:

an elongated member having a length sufficient to completely encircle about a midsection of an animal, said elongated member having inner and outer surfaces, the inner surface being disposed in a partial overlap with the outer surface and facing toward the animal during use;

gripping members extending from the inner surface toward the animal to increase rotatable friction forces and to decrease the likelihood that the elongated member will rotatably slip when secured into place around the animal;

first interlocking hook and loop type fastener material affixed onto portions of the surfaces of the elongated member at preselected locations for selectively adjusting and securing a circumferential extent of the elongated member about the animal;

second interlocking hook and loop type fastener material affixed at a saddle receiving portion of the girth and comprising a first saddle fastening means adapted for receiving and engaging a saddle having mating hook and loop type fasteners on the second material;

second saddle fastening means carried by said elongated member for affixing the saddle to the girth; and, reinforcement material included on the elongated member at said saddle receiving portion.

2. The girth of claim 1 wherein the gripping members comprise a plurality of projections extending from the inner surface of the elongated member in parallel relationship and disposed generally perpendicularly to the length of the elongated member.

3. The girth of claim 1 wherein the gripping members comprise a plurality of projections extending from the inner surface of the elongated member disposed in a parallel relationship at an oblique angle to the member.

4. The girth of claim 1 wherein the second saddle fastening means includes a hinge and ratchet device.

5. A girth comprising:

an elongated member having a length sufficient to completely encircle about a midsection of an animal, said elongated member having inner and outer surfaces, the inner surface being disposed in at least a partial overlapped wrapped relation with the outer surface and facing toward the animal during use;

gripping members extending from the inner surface for increasing friction forces and for decreasing the likelihood that the elongated member will rotatably slip when secured into place around the animal;

fastening means carried by said elongated member for affixing a saddle thereto and defining a saddle receiving portion; and, reinforcement material joined to said elongated member at least in said saddle receiving portion.

6. The girth of claim 5 wherein interlocking hook and loop type fasteners affixed in proximity to the ends of the elongated member for adjusting and securing a circumferential extent of the elongated member about the animal, the hook and loop type fasteners further affixed at the saddle receiving portion.

7. The girth of claim 5 wherein the gripping members comprise a plurality of projections extending in parallel from the inner surface of the elongated member, the projections being of varying widths and lying perpendicular to the length of elongated member.

8. The girth of claim 5 wherein the gripping members comprise a plurality of projections extending from the inner surface of the elongated member, said projections being parallel and lying in oblique angular relation to the length of the elongated member.

9. The girth of claim 5 wherein the fastening means includes a hinge and ratchet device.

* * * * *